US007322271B2

(12) United States Patent
Pecorari

(10) Patent No.: US 7,322,271 B2
(45) Date of Patent: Jan. 29, 2008

(54) ROTARY RADIAL PISTON MACHINE

(75) Inventor: Gabriele Pecorari, Modena (IT)

(73) Assignee: Ecotec SRL, Modena (IT)

( * ) Notice: Subject to any disclaimer, the term of this patent is extended or adjusted under 35 U.S.C. 154(b) by 547 days.

(21) Appl. No.: 10/501,316

(22) PCT Filed: Jan. 13, 2003

(86) PCT No.: PCT/IT03/00008

§ 371 (c)(1),
(2), (4) Date: Jul. 13, 2004

(87) PCT Pub. No.: WO03/060321

PCT Pub. Date: Jul. 24, 2003

(65) Prior Publication Data

US 2004/0255773 A1 Dec. 23, 2004

(30) Foreign Application Priority Data

Jan. 16, 2002 (IT) ..... BO2002A0021

(51) Int. Cl.
*F04B 1/107* (2006.01)
*F04B 1/04* (2006.01)

(52) U.S. Cl. ..... 91/498; 91/494; 92/72; 92/12.2

(58) Field of Classification Search ..... 91/494, 91/495, 498; 92/12.2, 72
See application file for complete search history.

(56) References Cited

U.S. PATENT DOCUMENTS 2,000,271 A 5/1935 Benedek
2,173,432 A 9/1939 Benedek
2,556,717 A 6/1951 Benedek
3,063,380 A * 11/1962 Strickland ..... 92/58
3,199,460 A 8/1965 Bush et al.
3,949,648 A * 4/1976 Eickmann ..... 91/492
4,475,870 A * 10/1984 Eickmann ..... 417/206
4,635,853 A * 1/1987 Mowbray ..... 239/533.3
5,503,535 A * 4/1996 Thoma et al. ..... 417/219
5,651,301 A * 7/1997 Thoma et al. ..... 91/491
5,848,565 A * 12/1998 Thoma ..... 91/491
6,109,884 A * 8/2000 Kita ..... 417/273

FOREIGN PATENT DOCUMENTS

GB 578 392 A 6/1946
GB 678 917 A 9/1952

* cited by examiner

*Primary Examiner*—Anthony D. Stashick
*Assistant Examiner*—Leonard J Weinstein
(74) *Attorney, Agent, or Firm*—Welsh & Katz Ltd.

(57) ABSTRACT

A rotary displacement machine (10) with radial pistons (19), includes a bearing (29) having a rotating thrust ring (28) and a stationary outer ring (30), with bearing rollers (31) therebetween. The thrust ring (28) includes one engagement device (43, 45) per piston (19), the engagement device (43, 45) allowing movement in a straight line along a second direction defined by a second axis (b) perpendicular to a first longitudinal centerline (a) of the piston (19).

24 Claims, 7 Drawing Sheets

SEZ.A-A

CAN1
CAN2

SEZ. C-C

SEZ. B-B 15
15a
15b
15c
15d
15e
15f
20
21
22
23
24
25
22≡23
24≡25
S1'
S1"
S3'
S3"
GF
B
C
M

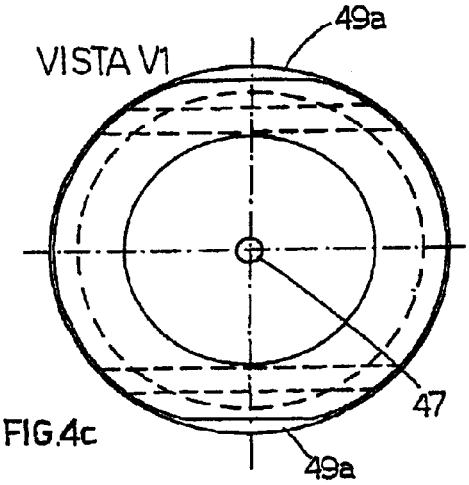
FIG.4c
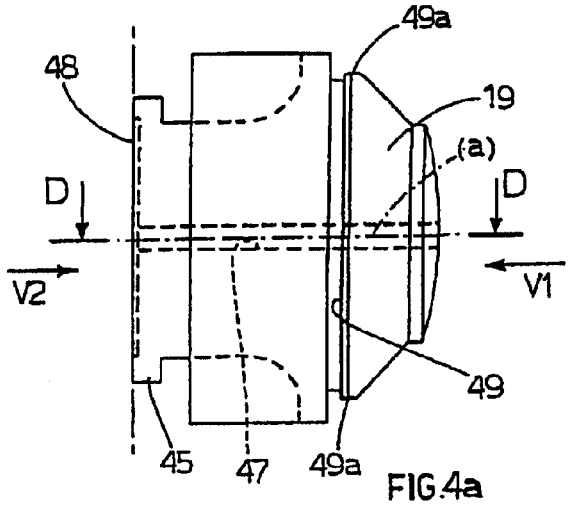
FIG.4a
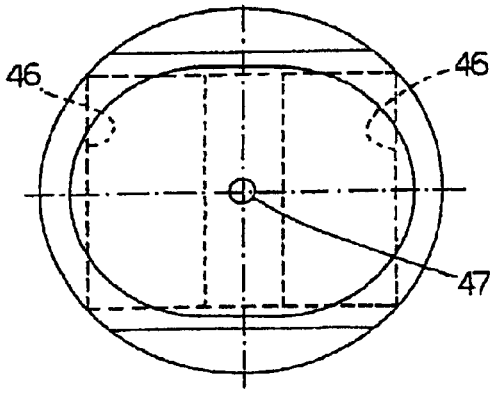
FIG.4d
VISTA V2
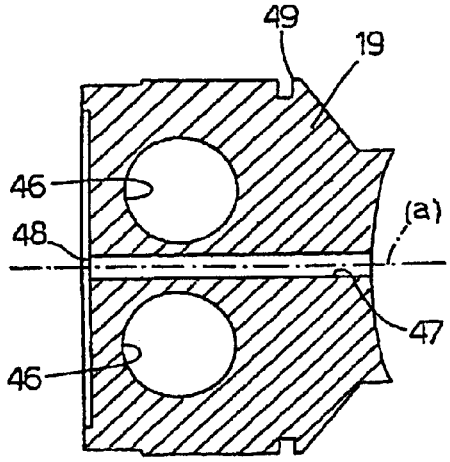
SEZ.D-D
FIG.4b
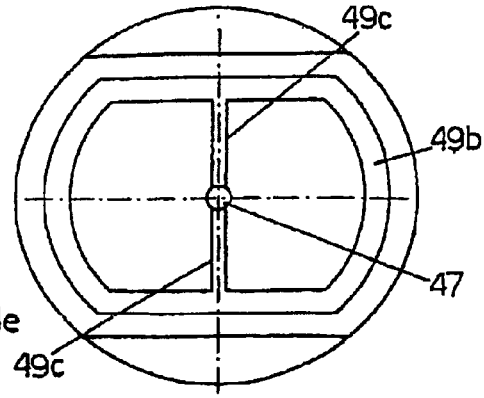
FIG.4e
Fig.4

FIG.7b SEZ.E-E

ROTARY RADIAL PISTON MACHINE

The present invention relates to a radial piston type of rotary displacement machine.

While the complement of this description deals with a radial piston type of rotary displacement machine functioning as a pump or a motor operated on a working fluid (e.g. air, water, oil), it should be understood that the teachings of this invention would equally apply to an internal combustion type of displacement machine, i.e. a rotary displacement machine where a combustible mixture is conventionally ignited within its radial cylindrical chambers.

Radial piston rotary displacement machines have long been known which comprise:

a supporting structure;

a centrally mounted distributor;

a rotating unit comprising a rotor provided with a number of radially extending cylindrical chambers, wherein each chamber contains a respective piston mounted for sliding movement in a first direction along a first axis coaxial with the longitudinal centerline of the respective cylindrical chamber;

means of opposing the radial thrust from the pistons, said means forming a bearing in combination with an inner ring;

support means carrying the rotation unit; and alignment means for maintaining the coaxial relationship of the distributor to the rotor.

The following basic problems are encountered with such rotary volumetric machines of conventional design:

(1) since the piston head is in spot contact with the inner surface of the bearing, unacceptable concentrated loading is incurred, so that the design can only be adopted on machines having small-diameter pistons that are operated on relatively low pressures;

(2) the spot contact makes adequate hydraulic balancing impossible to achieve;

(3) no pressure surge control is provided for the piston; accordingly, any pressure drops in the hydraulic circuits are liable to result in the piston jumping off the bearing ring and producing knock that may harm the piston head as well as the thrust ring;

(4) a rotary displacement machine of this design has no arrangements for synchronizing the rotor and thrust ring rotations and preventing the piston heads from rubbing against the inner surface of the ring;

(5) the pistons of a machine of this design mount no seal rings;

(6) the rotor may come in frictional contact with the distributor, thereby lowering the overall mechanical effectiveness of the machine; and finally (7) the distributor timing to the piston stroke cannot be adjusted.

A primary object of this invention is, therefore, to keep the piston under control without letting the piston lose contact with the surface of the thrust ring.

In addition, additional object of this invention is to provide a radial piston rotary displacement machine that has none of the drawbacks mentioned above.

This object is achieved by a radial piston rotary displacement machine according to claim 1.

The invention will now be described with reference to the accompanying drawings, which show a non-limitative embodiment of the invention, in which:

FIG. 4 shows a piston incorporated in the rotary displacement machine of FIGS. 1 and 2;

Figure 1:
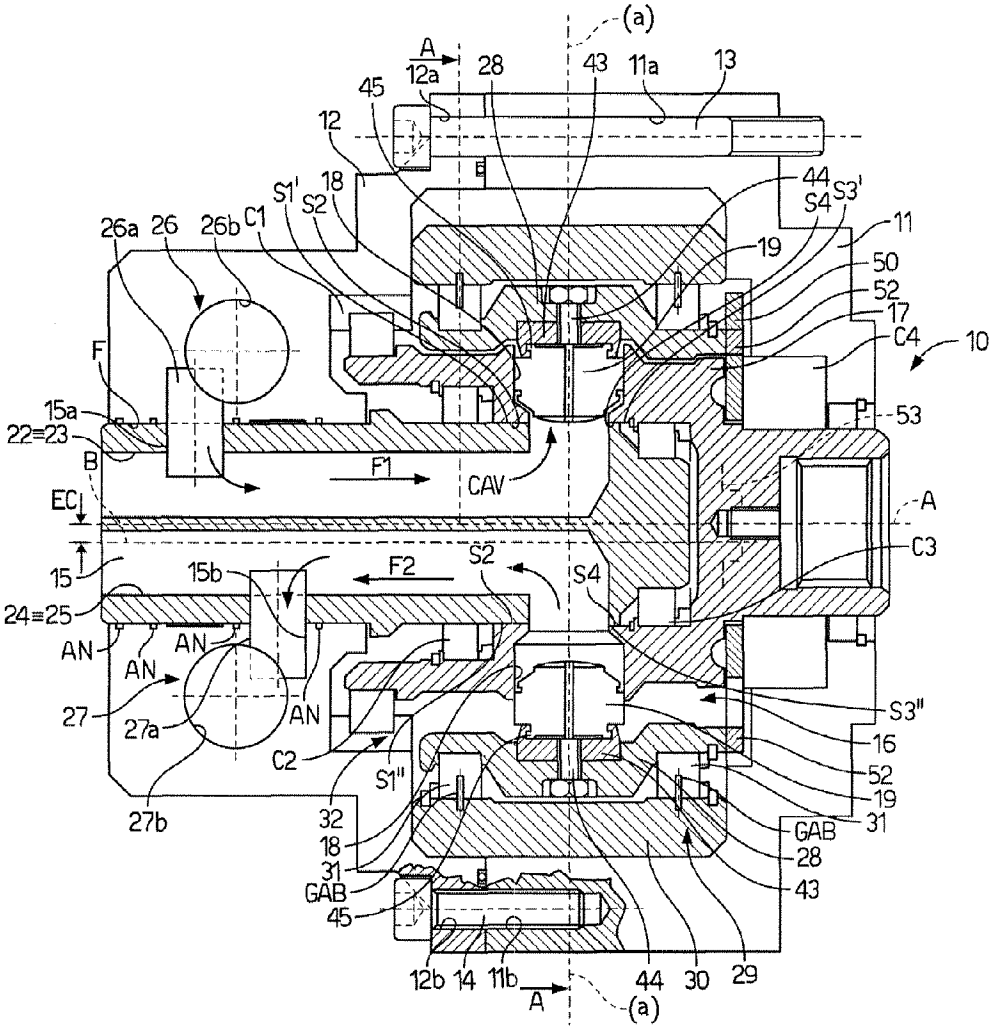
FIG. 1 is a longitudinal cross-section taken through the radial piston rotary displacement machine of this invention.

Note should be made that in the drawing figures, only such mechanical details as are necessary to an understanding of this invention are shown and referenced.

Figure 2:
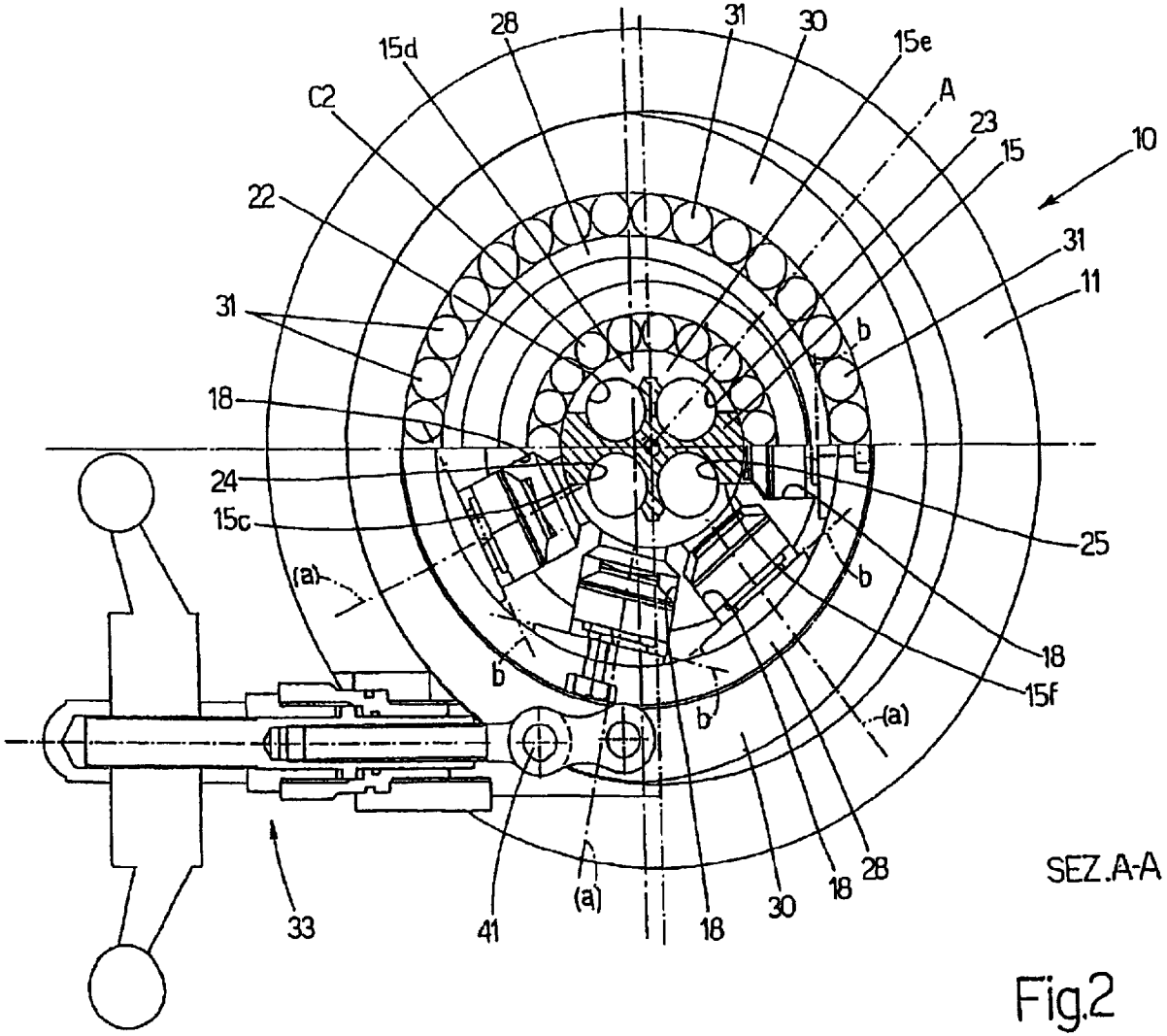
FIG. 2 is a transverse cross-section taken along line A-A in FIG. 1.

Shown at 10 in FIGS. 1 and 2 is a radial piston rotary displacement machine according to the invention.

The machine 10 comprises a main body 11 that is configured into a substantially closed shell by a cover 12. The main body 11 and its cover 12 are held together by screw fasteners 13 and 14.

As shown in FIG. 1, the bolt 13 (also useful to secure the machine 10 on a supporting structure, not shown) is passed here through clearance holes 11*a* and 12*a* formed through the main body 11 and the cover 12, respectively, and the screw 14 is threaded into two threaded holes 11*b* and 12*b* which are also formed in the body 11 and the cover 12. The embodiment shown has four bolts 13 (only one being shown in FIG. 1) and two screws 14 (only one being shown in FIG. 1).

The space between the main body 11 and the cover 12 accommodates a distributor 15 of whatever fluid. The distributor 15 is substantially cylindrical in shape about an axis A, and is illustrated in greater detail in FIG. 3.

As explained hereinafter, the distributor 15 is mounted to float within the space defined by the cover 12, but is not rotated about the axis A that also forms its longitudinal centerline.

Furthermore, the distributor 15 is encircled by a rotating unit 16 (FIG. 1) which comprises a rotor 17 arranged to turn about the same axis A as the distributor 15.

The rotor 17 is formed conventionally with a plurality of radially extending cylindrical chambers 18 (only two being shown in FIG. 1), each chamber being adapted to receive a respective piston 19 for movement along a radial direction (a) as shall be subsequently better illustrated.

Figures 3, 3A, 3B, 3C:
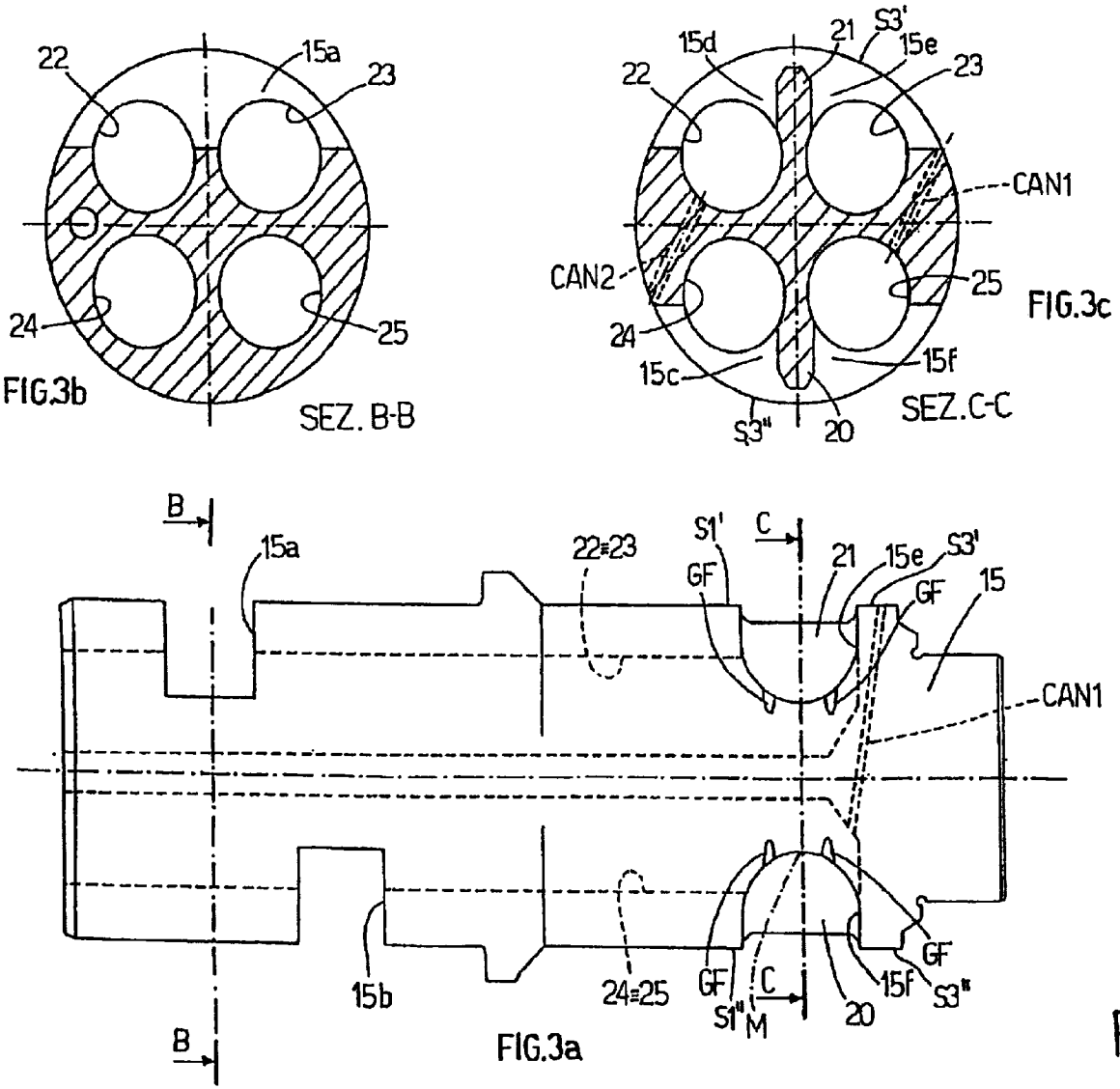
FIG. 3 shows a substantially cylindrical distributor incorporated in the rotary displacement machine of FIGS. 1 and 2.

As shown in FIGS. 1 and 3, the distributor 15 is formed with two slots 15*a*, 15*b* and four cutouts 15*c*-15*f*. The cutout pairs 15*c*, 15*f* and 15*d*, 15*e* are each provided with a bracing rib 20 and 21.

As can be seen from the combined FIGS. 3*a*, 3*b* and 3*c*, the slot 15*a* is communicated to the cutouts 15*d*, 15*e* by a pair of conduits 22 and 23, the fluid connection between the slot 15*b* and the cutouts 15*c*, 15*f* being established by conduits 24 and 25.

The conduits 22-25 open at their left end as shown in FIG. 3*a*.

As depicted in FIGS. 1 and 2, each radial cylindrical chamber 18 will be placed sequentially in fluid communication with the cutouts 15*c*-15*f* as the rotor 17 turns about the axis A.

In the embodiment shown, assuming the machine 10 is to be operated as a hydraulic motor, the machine 10 would be supplied pressurized oil through the conduits 22, 23, the oil being then discharged through the conduits 24, 25. For the purpose, the cover 12 is provided with an oil intake device 26 effective to deliver the pressurized oil incoming from a remote source, and with an oil discharge device 27.

In particular, the intake device 26 comprises the aforementioned cutout 15*a* in the distributor 15 (FIGS. 3*a-b*), a corresponding groove 26*a* formed in the cover 12 at an offset location from the axis A, and an intake port 26*b*.

Likewise, the discharge device 27 comprises the aforementioned cutout 15*b* in the distributor 15 (FIGS. 3*a-b*), a corresponding groove 27*a* formed in the cover 12 at an offset location from the axis A, and a discharge port 27*b*.

In this example, the oil inflow runs in the direction of arrow F1, and the oil outflow in that of arrow F2.

As shown in FIG. 1, each piston 19 is engaged with the thrust ring 28 of a bearing 29 by means to be described.

The ring 28 is, moreover, an integral part of the rotating unit 16, which unit includes, as said before, the rotor 17 and pistons 19.

In other words, the thrust ring 28 also forms the inner ring of an integral bearing 29 that additionally comprises an outer ring 30 and two sets of cylindrical rollers 31 conventionally disposed between the inner ring 28 and the outer ring 30.

The combination of the multiple rollers 31 and outer ring 30 provides a means of opposing the radial thrust forces from the pistons 19.

Also, integral bearing means C1, C4 are arranged to support the rotating unit 16 and take up the forces from the pistons 19, and integral means of alignment C2, C3 are arranged to maintain the coaxial relationship of the distributor 15 and rotor 17 along the axis A, this alignment being made crucial by the provision of an odd number of pistons 19.

The term "integral bearing" encompasses here a design where the bearing races are formed directly on the members of the machine 10, i.e. no intermediate rings are provided.

Advantageously, the bearings C1-C4 are an interference fit to prevent creeping of the axis A of distributor 15.

The outer ring 30 is held stationary and has a centerline B (FIG. 1) generally offset from the axis A; it can be shifted radially by means of an adjuster 33 (FIG. 2) intended for adjusting the offset EC (FIG. 1) between the lines A and B.

The adjuster 33 is a conventional design and no further described herein. In addition, the adjuster 33 may be a mechanical, hydraulic, electromechanical, or otherwise operated device.

The rotating unit 16 is driven conventionally. In an application where the machine 10 is operated in the hydraulic motor mode, head and delivery rate are converted within the machine 10 to rotary power by the rotating unit 16, specifically the rotor 17, due to the piston heads 19 urging against the ring 28, and due to the thrust forces being offset by the amount EC. This offset EC is essential to the rotation of the unit 16. Should the offset EC be nil, no rotation would be possible because the thrust ring 28 would enter a stalled condition.

Figure 5A:
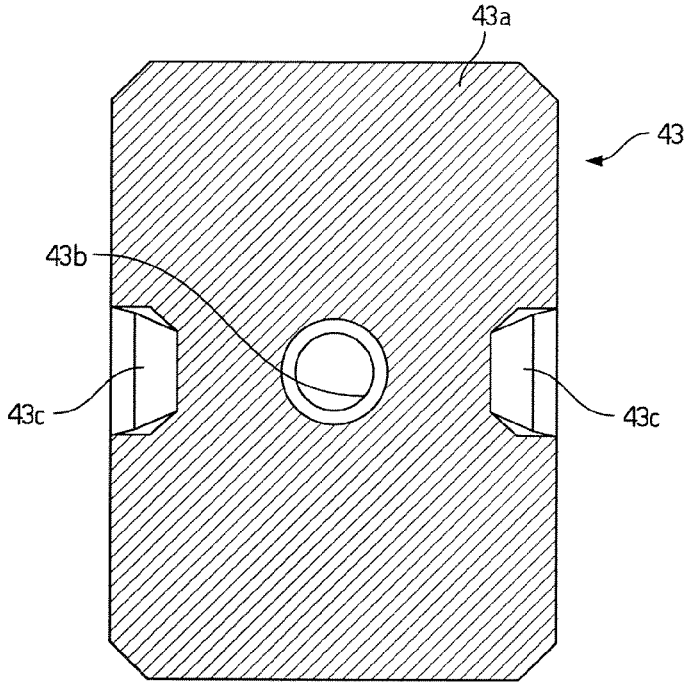
FIG. 5 shows an engagement slide rail incorporated in the rotary displacement machine of FIGS. 1 and 2.
Figure 5B:
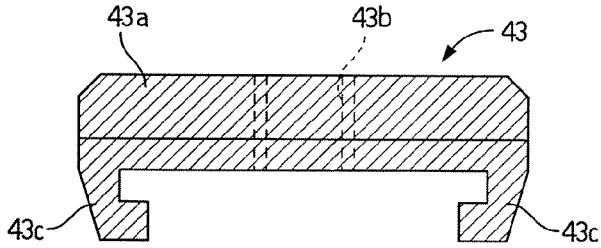
Figure 5C:
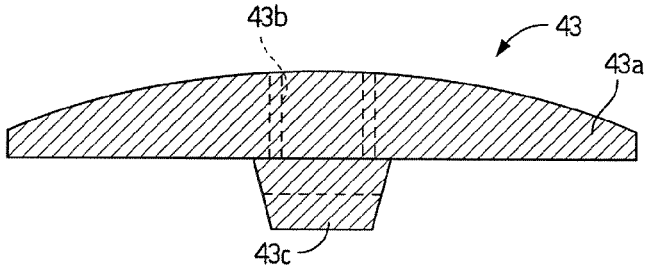

As mentioned before and shown in FIG. 4, each piston 19 is shaped for engagement with the ring 28. Sliding engagement is achieved by contour shape, comprising a slide rail 43 (FIG. 5) attached to the rotating ring 28 by a screw 44. A slide 45 (FIG. 4) is formed integrally on the head of the piston 19 to allow small movements of the piston 19 relative to the ring 28. As shown in FIG. 2, the movements of the slide 45 along the slide rail 43 take place in a straight direction along an axis (b) perpendicular to the aforesaid axis (a) along which the piston 19 moves radially. The axis (a) also is, as mentioned, the centerline of the radial cylindrical chamber 18 in which the piston 19 is movable.

In other words, the slide rail 43 extends perpendicularly to the direction of the axis (a), and ensures that no cocking of the axis (a) of the piston 19 may occur with respect to the axis of the chamber 18.

These movements of the piston 19 along the axis (b) are needed to adapt the piston setting for the geometrical conditions that prevail during the rotation of the rotating unit 16. The slide rail 43 of this embodiment is illustrated in greater detail in FIG. 5.

The slide rail 43 comprises a body 43*a* which is formed with a threaded hole 43*b* receiving the screw 44 threadably therein (FIG. 1). Two jaws 43*c* jut out of the body 43*a* to engage the slide 45, the latter being as mentioned integral with the piston 19.

In an embodiment not shown, the slide rail 43 is integral with the ring 28.

The function of the slide rail 43 made integral with the ring 28, and of the slide 45 that is formed integrally with the piston head 19, is fundamental to this invention. As previously mentioned, in one of the commercially available embodiments, the head of the piston 19 is mounted to merely rest onto the thrust ring 28. Thus, surges involving a pressure drop through the hydraulic circuit are liable to cause the piston 19 to move away from the surface of the ring 28. As the rotational movement goes on, the piston 19 is bound to meet geometrical and kinematic conditions that will urge it back against the inner surface of the ring 28, thereby initiating a series of piston 19 knocks on the ring which may seriously harm the piston head 19 and the inner ring 28 surface as well.

Accordingly, it matters in this invention that the head of the piston 19 cannot become detached from the inner surface of the ring 28, so that pressure surges through the hydraulic circuit will not harm the above parts.

Also, the inner ring 28 may advantageously be provided a substantially sinusoidal shape, such that the two sets of rollers 31 can be received in two side races, with the roller sets located on either side of the slide rail 43.

Referring back to FIG. 4, it can be seen that the piston 19 and its attached slide 45, is formed with a pair of lightening holes 46 drilled crosswise through it for reduced inertia. In addition, the piston 19 is drilled along the axis (a) with a small hole 47 allowing a determined amount of oil to flow into a recess 48 in the head of the piston 19 itself. The amount of oil admitted through the hole 47 is to balance out hydraulically the forces acting on the piston 19.

As shown in FIG. 4*b*, the centerlines of the holes 46 extend parallel to each other crosswise to the axis (a) of the hole 47. This allows the piston 19 to be lightened at no consequence for the diameter of the hole 47. In another embodiment not shown, the holes 46 do not go through, but converge radially on the hole 47 to a point somewhat short of it.

The outer surface of the piston 19 is formed with a groove 49 (FIGS. 4*a-b*) that can receive a seal ring (not shown). In addition, two cutouts 49*a* are formed opposite to each other at the location of the groove 49, as shown in FIGS. 4*a-c*. These cutouts 49*a* enable said seal ring (not shown) to be installed.

As shown in FIGS. 4*a-b*, the far surface from where the recess 48 is shaped to restrict the clearance between the skirt of the piston 19 and its chamber 18.

FIG. 4*e* shows an alternative embodiment of the piston 19 that differs from that shown in FIGS. 4*a-d* only by the configuration of one of the front faces of the piston 19.

In this embodiment, the recess 48 shown in FIGS. 4*a-b* is replaced by a groove 49*b* that matches the contour of the head surface of the piston 19. This groove 49*b* is in fluid communication with the hole 47 through two radial canalizations 49*c*. This configuration affords increased surface area for improved hydrodynamic effect where this is required.

Figure 6:
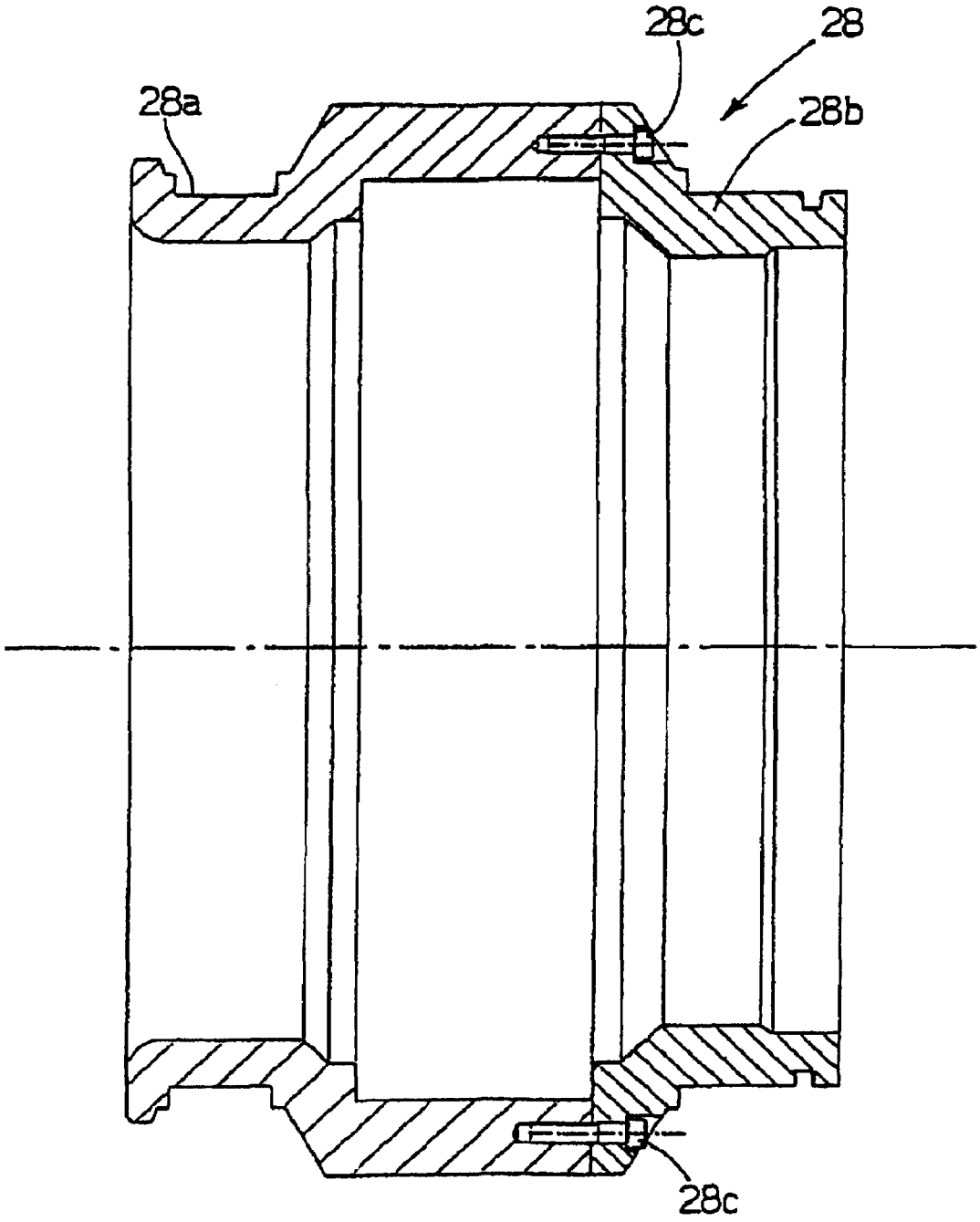
FIG. 6 shows the thrust ring (inner ring) of a rotor bearing incorporated in the rotary displacement machine of FIGS. 1 and 2.

A modified embodiment of the ring 28 is shown in FIG. 6, wherein the ring 28 is split to provide two separate portions 28*a*, 28*b* that can be joined together by means of a set of screws 28*c* (only two screws 28*c* being shown in FIG. 6).

This embodiment allows the rotor 17 to be inserted into the portion 28*a* complete with pistons 19 and associated slides 45, without incurring interference with the small diameter of the portion 28*a*. This allows the system displacement to be increased substantially, since longer cylinders 19 and longer strokes can be used.

An outer ring 30 formed of two parts that can be assembled together conventionally, e.g. by welding along their centerline, could be provided instead.

As shown in FIG. 1, moreover, the piston 19 is quite short, and part of the engaging arrangement to the inner ring 28, with the piston 19 at either dead center (top half of FIG. 1), is nested within the respective chamber 18. This greatly reduces the machine 10 cross-section outline, and with it the inertia of the moving masses during rotation of the rotating unit 16.

FIG. 1 shows that the rotor 17 carries the distributor 15 through the bearing pair C2, C3.

Furthermore, as any of the bearings C1-C4 and bearing 29, disk-cage bearings GAB may be used to advantage, as described in WO 01/29439 and only shown here as to bearing 29. Optionally, the cages GAB may be closed, viz. unsplit, cages rather than split cages as described in the above document.

By using unsplit disk cages GAB for the bearings of the machine 10, the life span of the latter can be extended considerably. The unsplit disk cage GAB is effective to bring the loss of rollers down to 7-10%, as against 30% with conventional cage designs. This represents an important improvement in terms of allowable loading and speed, and consequently of output power. Although each cage GAB is shown mounted centrally of its associated set of rollers 31, different arrangements may provide for the cage GAB to be mounted peripherally of the roller set 31.

In the embodiment shown, the spacing of these bearings C2 and C3 along the axis A is quite small. Accordingly, deflection of the distributor 15 to rub against the rotor 17 is effectively avoided, even where the clearance between these parts is quite narrow.

As shown in FIGS. 1 and 3, the surface of the distributor 15 included between the two bearings C2 and C3 and involved in the fluid distribution process has portions S1', S3', S1", S3" facing the cutouts 15*d*, 15*e* and cutouts 15*c*, 15*f*, respectively.

These portions S1', S3', S1", S3", and the corresponding surfaces s2 and s4 of the recess CAV in the rotor 17 (FIG. 1) may be conical rather than cylindrical in shape as shown in the drawings. Clearly S1' and S3' have a single cone generatrix line, as have the pair S1', S3' on one side, and the pair S2, S4 on the recess CAV side. In this way, the amount of oil that is allowed to leak into the distribution area can be adjusted by shifting the distributor 15 along the axis A. Consequently, a virtually complete seal-off could be provided instead.

Alternatively, compromise arrangements could be provided, e.g. one that would admit significant leakage of pressurized oil in order to lubricate other system parts.

The oil pressurization at the cutouts 15*d*, 15*e* is bound to generate radial loads that would be transferred to some extent onto the surfaces S1" and S3" of the distributor 15. Likewise, pressurization of the oil at the cutouts 15*c*, 15*f* is bound to generate radial loads that would be transferred to some extent onto the surfaces S1' and S3' of the distributor 15. This makes counterbalancing such radial loads hydraulically a necessity if rubbing contact of the distributor 15 against the recess CAV in the rotor 17 is to be prevented. For the purpose, and as shown in FIGS. 3*a* and 3*c*, canalizations are provided such as the canalization CAN1 that place the conduit 25 in fluid communication with the surface S3' of the distributor 15. The surfaces S1', S2" and S3" are similarly communicated to their respective conduits. For example, the surface S3" is placed in fluid communication with the conduit 22 through a canalization CAN2 (FIG. 3*c*). In this way, a passage is created for the fluid between the surfaces S1', S3', S1", S3" on the one side, and the surfaces S2, S4 of the recess CAV, on the other.

This passage is useful to balance out the hydraulic forces.

As a result, the bearings C2 and C3 are only called upon to bear the alternating loads from the interconnection area between the distributor 15 and the radial cylindrical chambers 18, in addition to loads due to any imprecise balancing.

Also, this arrangement is innovative in that the distributor portion 15 found to the left of the bearing C2 is free to float under the cover 12. A hole F in the cover 12 accounts for the floating feature of the distributor 15.

To prevent oil from leaking through a clearance between the outer surface of the distributor 15 and the surface of the hole F, ring seals AN are provided at either ends of the devices 26, 27. These ring seals AN fit in closed seats formed in the surface of the hole F in the cover 12. "Closed seat" refers here to an annular groove formed in the cover 12. Advantageously, moreover, the rings AN are made of appropriate materials (steel, Teflon(r), etc.) for the pressure, temperature, and amount of clearance anticipated.

The floating feature of the distributor 15 is also essential to this invention.

In fact, the outer surface of the distributor 15 must be prevented from contacting the inner surface of the rotor 17 at all cost. By inhibiting all contact, no frictional drag would be incurred, and the efficiency is maximized.

By thus preventing all contact, the contamination problem due to various particles being introduced with the oil is also solved.

All the moving parts of this invention are, advantageously but not necessarily, case hardened parts to a hardness of about 60 HRC. However, the distribution surfaces S1', S1", S3', S3", S2 and S4 adjacent to the cutouts 15*c*-*f* (see also FIG. 3*c*) should advantageously have hardness of 1400 HV or above.

By providing the bearings C2, C3 and the balanced hydraulics as described hereinabove, any use of anti-friction metals such as bronze and other copper alloys, cast iron, aluminum alloys, etc. in the construction of the rotor 17, for example, is made unnecessary.

By providing a floating distributor 15, the machine 10 can be timed for optimum performance.

Any piston machine presents the problem of variable timing. The chamber injecting or discharging functions require to be advanced or retarded relative to the dead centers according to such factors as pressure, rotation, etc.

By having the distributor 15 unconnected to any other parts, it can be turned through a given angle using means not shown, to advance or retard the intake and discharge phases as required.

Phase adjustment may be made necessary by the presence of clearance, and by a varying pressure, rotation, displacement, etc. As the intake and discharge phases are optimized, the system will run quieter and vibration become trivial. In addition, the bearings extend their life span, and the output torque of the machine 10 is made steadier.

Any resetting of the distributor 15 would be a trial-and-error process, because each machine 10 is to be timed separately.

Also, the motion of the rotor 17 is reversed when the distributor 15 is rotated 180 degrees.

In addition to the above angle adjustment, and if machine 10 is operated in the pump mode as well as the motor mode, so that the distributor 15 is to function in either situation, axial adjustment (along axis A) must be performed using two grooves GF offset from the centerline M (see FIG. 3*a*).

Thus, for quiet vibration-less running, two grooves GF should be provided for use, the one when the machine 10 is operated in the pump mode and the other when in the motor mode.

Position shifting along the axis A for selection of the groove GF is also significant when the machine 10 is operated as a clockwise or counterclockwise rotating pump.

A person skilled in the art will recognize that by enabling the distributor 15 to be shifted both angularly and axially along axis A, a variety of demands on the machine 10 can be filled.

Also, the invention includes a cross coupling 50 (FIGS. 1 and 7), whereby the ring 28 of the bearing 29 against which the pistons 19 are urged can turn in perfect synchronization with the rotor 17.

The cross coupling 50 also effectively minimizes the requirements of the piston 19 for guide inside its chamber 18.

"Guide" is used here to indicate that portion of the chamber wall which remains in contact with the piston surface when the piston 19 is moved to its farthest position out of the chamber 18.

The cross coupling 50 and the slides 45 keep the piston 19 aligned to the chamber 18, so that short guides can be used and radial bulk reduced.

By contrast, in state-of-art embodiments having no cross coupling 50, a piston guide whose length amounts to 50% and 100% of the piston 19 diameter must be provided.

Figures 7, 7A:
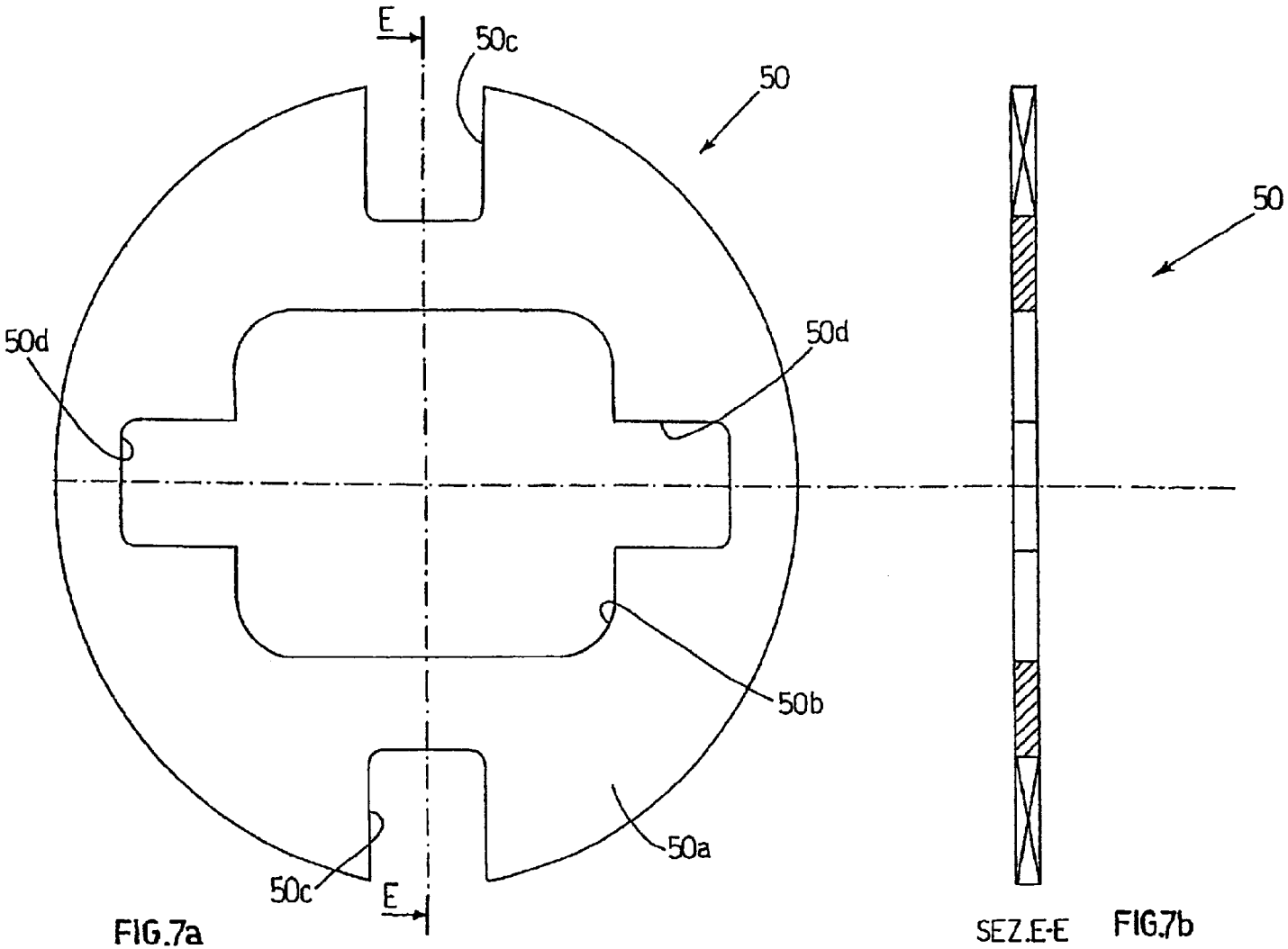
FIG. 7 shows a device synchronizing the rotation of the rotor and that of the bearing inner ring.

More particularly, the cross coupling 50 comprises, as shown best in FIG. 7, a plate 50*a* advantageously made of treated steel. The plate 50*a* is formed with a center hole 50*b*, and two peripheral notches 50*c* receiving two cogs 52 (FIG. 1) of the ring 28. Two prismatic guides 50*d* are arranged to guide the movements of two cogs 53 (only one being shown in dash lines in FIG. 1) integral with the rotor 17. The prismatic guides 50*d* are connected to the substantially rectangular center hole 50*b*. The shape of the center hole 50*b* is effective to only allow movement of the cogs 53 along the direction of the long side of the center hole 50*b*.

It will be appreciated that other conventional devices, such as a constant velocity joint, gear pairs, etc. could be employed to keep the ring 28 synchronized with the rotor 17.

Finally, in the tight fit of the distributor 15 and rotor 17, the rotor mating surface may advantageously be nitrided to have it withstand local heating and obviate seizure.

Lastly, the rotary displacement machine described above could have the roll bearings 29 or C1 or C4 replaced with plain bearings having a sliding means formed of at least one layer of an anti-friction plastics material bonded through an additional layer of a porous metal, on one of the contacting parts or an intervening metal element.

The advantages of this rotary displacement machine 10 are:

compared with current displacement machines, approximately 70% less friction; the range of displacement machines that can be produced is therefore extended from 1 cm3 capacity to more than 30,000 cm3, while retaining a high efficiency;

for the same size, this system affords a higher power output than conventional machines, since it can attain higher speeds;

both the working pressure and the power output can be increased by virtue of a lower specific loading, particulate contaminants would cause no significant harm since all the moving parts are surface hardened;

the thrust ring and rotor rotations are exactly synchronized, leaving the pistons and engagement arrangements unharmed;

a distributor which is mounted floating;

the machine timing can be adjusted by rotating and/or shifting the distributor axially;

the rotary displacement machine performs equally well in the pump and motor modes;

when the rotary displacement machine is operated in the pump mode, the pump may be made to turn clockwise or counterclockwise by merely changing the axial placement of the distributor.

While the machine of this invention has been described essentially as a hydraulic motor or a hydraulic pump, it should be understood that the machine could also function as a hydraulically operated speed variator.

The invention claimed is:

1. A rotary displacement machine with radial pistons; rotary displacement machine, comprising:

a supporting structure, with a main body and a cover;

a centrally mounted distributor;

a rotating unit comprising a rotor provided with a number of radially extending cylindrical chambers, wherein each chamber contains a respective piston mounted for sliding movement in a first direction along a first axis coaxial with the longitudinal centerline of the respective cylindrical chamber; and means of opposing the radial thrust from the pistons, said means forming a bearing in combination with an inner ring;

the bearing comprising the rotating inner ring, a stationary outer ring, and intervening rolling means, the rotating inner ring including sliding engagement means for each piston, the engagement means allowing movement in a straight line along a first direction defined by a second axis perpendicular to the first axis, wherein the engagement means comprise a slide rail attached to the inner ring, and a slide attached to the head of the piston, the slide being a flat slide, so that the relative paths of movement of the slide and the slide rail are straight paths of movement along the second axis.

2. A rotary displacement machine as claimed in claim 1, wherein the force of the piston is transferred to the inner ring through a hydraulically balanced end surface.

3. A rotary displacement machine as claimed in claim 1, wherein at least one of said pistons is provided with a closed seal ring.

4. A rotary displacement machine as claimed in claim 1, wherein at least one of the pistons is facing the distributor with a face shaped to fill unwanted clearance.

5. A rotary displacement machine as claimed in claim 1, wherein one of the pistons is located entirely within the respective radial cylindrical chamber, and at least a portion of the slide rail is located within the radial cylindrical chamber.

6. A rotary displacement machine as claimed in claim 1, wherein the inner ring has a sinusoidal shape, such that it can accommodate two sets of rolling bodies in two side races, they being placed on one side of the slide rail.

7. A rotary displacement machine as claimed in claim 1, wherein one of the pistons is located entirely within the respective radial cylindrical chamber, at least a portion of the slide rail is located within the radial cylindrical chamber.

8. A rotary displacement machine as claimed in claim 1, wherein the rotor has a nitrided surface in the area of coupling to the distributor.

9. A rotary displacement machine as claimed in claim 1, wherein at least one piston is formed with at least one lightening hole.

10. A rotary displacement machine as claimed in claim 9, wherein the longitudinal axis of said hole extends transverse to the first axis of the piston and does not cross a hydraulic balancing hole formed in the piston.

11. A rotary displacement machine as claimed in claim 1, wherein said rotor and inner ring are controlled to rotate synchronously by a synchronization device.

12. A rotary displacement machine as claimed in claim 11, wherein said synchronization device is a cross coupling.

13. A rotary displacement machine as claimed in claim 1, wherein said rotor is mounted by bearings in the main body and cover and the distributor is mounted to float within a space defined by the cover and is held in a coaxial relationship in the rotor by bearing means.

14. A rotary displacement machine as claimed in claim 13, wherein at least one of the bearings is an integral bearing.

15. A rotary displacement machine as claimed in claim 13, wherein at least one of the bearings mounts a plurality of rolling bodies in interference fit relationship.

16. A rotary displacement machine as claimed in claim 13, wherein the placement of said distributor can be adjusted both angularly and axially along a longitudinal centerline.

17. A rotary displacement machine as claimed in claim 13, wherein at least a surface portions of the distributor and the surface portions of a recess provided on the rotor have a conical shape allowing said surface portions to fit together in different ways.

18. A rotary displacement machine as claimed in claim 13, wherein at least one of the bearings for the rotor and/or for coupling the inner and outer rings together provides frictional drag in which sliding means are provided which comprise at least one layer of an anti-friction plastics material bonded, through an additional layer of a porous metal, to one of the contacting parts or another intervening metal element.

19. A rotary displacement machine as claimed in claim 13, wherein at least one of the bearings mounts an unsplit disk cage.

20. A rotary displacement machine as claimed in claim 19, wherein each unsplit disk cage is mounted peripherally of the respective set of rolling bodies.

21. A rotary displacement machine as claimed in claim 13, wherein seal rings of metal are arranged to stop oil from leaking through the clearance gap between the outer surface of the distributor and the surface of an opening in the cover.

22. A rotary displacement machine as claimed in claim 21, wherein the seal rings are received each in a respective annular seat formed in the surface of the opening formed in the cover.

23. A rotary displacement machine as claimed in claim 13, wherein the cover carries an intake device and a discharge device, the intake and discharge devices being each formed with a respective offset groove from a centerline of the distributor.

24. A rotary displacement machine as claimed in claim 23, wherein between the surface of the opening in the cover in which the distributor is mounted and the outer surface of the distributor are provided seal rings at either ends of the intake and discharge devices.

* * * * *